US008774693B2

(12) United States Patent
Yamana

(10) Patent No.: US 8,774,693 B2
(45) Date of Patent: Jul. 8, 2014

(54) FIXING DEVICE AND IMAGE FORMING APPARATUS

(71) Applicant: Sharp Kabushiki Kaisha, Osaka (JP)

(72) Inventor: Shinji Yamana, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 31 days.

(21) Appl. No.: 13/729,610

(22) Filed: Dec. 28, 2012

(65) Prior Publication Data

US 2013/0170881 A1 Jul. 4, 2013

(30) Foreign Application Priority Data

Dec. 28, 2011 (JP) ..... 2011-287841

(51) Int. Cl.
*G03G 15/20* (2006.01)

(52) U.S. Cl.
USPC ..... 399/329

(58) Field of Classification Search
USPC ..... 399/328, 329, 331
See application file for complete search history.

(56) References Cited

FOREIGN PATENT DOCUMENTS

| | | |
|---|---|---|
| JP | 2005-037825 | 2/2005 |
| JP | 2006-039184 | 2/2006 |
| JP | 2011-028040 | 2/2011 |

*Primary Examiner* — Walter L Lindsay, Jr.
*Assistant Examiner* — Barnabas Fekete
(74) *Attorney, Agent, or Firm* — Nixon & Vanderhye, P.C.

(57) ABSTRACT

A fixing device is provided with an endless fixing belt; a heating roller for heating the fixing belt; a fixing roller that has a shaft and extends the fixing belt between the fixing roller and the heating roller; a pressure roller for pressurizing the fixing roller via the fixing belt; and a deviation preventing member that is provided on the shaft of the fixing roller and suppresses moving of the fixing roller in a shaft direction. The fixing roller has an end portion with high hardness and an end portion with low hardness along the shaft direction of the fixing roller. The end portion with high hardness is in contact with the deviation preventing member.

2 Claims, 4 Drawing Sheets

FIXING DEVICE AND IMAGE FORMING APPARATUS

CROSS-NOTING PARAGRAPH

This non-provisional application claims priority under 35 U.S.C. §119(a) on Patent Application No. 2011-287841 filed in JAPAN on Dec. 28, 2011, the entire contents of which are hereby incorporated herein by reference.

FIELD OF THE INVENTION

The present invention relates to a fixing device for fixing a toner onto recording paper, and an image forming apparatus provided with the fixing device.

BACKGROUND OF THE INVENTION

As an electrophotographic image forming apparatus, a copier, a printer, a facsimile apparatus, a multi-functional peripheral thereof and the like have been widely used. By electrophotography, it is possible to easily form an image with favorable image quality. An image forming apparatus by such a method is provided with a fixing device, in which the fixing device heats a toner image that is formed on recording paper and fixes a fused toner onto the recording paper.

A fixing belt system fixing device has been well known. In the fixing belt system, an endless fixing belt is extended between a heating roller and a fixing roller. The heating roller incorporates a halogen heater and the like. In this belt system, a pressure roller is used, and the pressure roller pressurizes the fixing roller via the fixing belt. In a pressure-contact part between the pressure roller and the fixing belt, a nip portion is formed. When recording paper passes through the nip portion, a toner is fixed onto the recording paper.

The fixing belt moves and runs along a width direction of the fixing belt (also referred to as horizontal slide or meandering) in a state of being extended between the fixing roller and the heating roller. In a case where a pair of belt-deviation preventing members are provided on both ends of the heating roller, a center of the width direction of the fixing belt is easily brought close to a center of a shaft direction of the heating roller so that it is possible to prevent meandering of the belt. However, the fixing belt largely moves along the width direction and the fixing belt gets too close to one end of the heating roller, thereby causing a state where an end face of the fixing belt and the belt-deviation preventing member are brought into so-called surface contact with each other, so that the end face of the fixing belt is damaged or the like, which has been problematic.

Therefore, Japanese Laid-Open Patent Publication No. 2011-28040 discloses a method of making it difficult for a fixing belt to be damaged. As shown in FIG. 4A to FIG. 4C, in the fixing device described in the patent publication, a fixing belt 450 is extended between a heating roller 430 and a fixing roller 440, and a pair of belt-deviation preventing members 470 is provided on both ends of the heating roller 430.

The belt-deviation preventing member 470 is provided with a flange 472 that projects outside from an outer circumferential surface of the heating roller 430, and the flange 472 includes an annular curved surface 473. The annular curved surface 473 includes a wall surface part facing an end face of the fixing belt 450, and the wall surface part is curved toward a direction departing from the end face of the belt 450. This makes it possible to bring a state where the end face of the fixing belt 450 and the belt-deviation preventing member 470 are brought into almost so-called line contact with each other so as to make a contact range of the belt 450 and the member 470 small.

However, as shown in FIG. 4B, a deviation preventing member is not provided on each of both ends of the fixing roller 440. Thus, the fixing roller 440 is able to move freely in a shaft direction thereof. In a case where a moving direction of the fixing roller is consistent with a moving direction of the fixing belt that meanders, force for moving the fixing roller in the shaft direction and force for moving the fixing belt in the width direction get together, whereby the fixing belt 450 is brought into extreme contact with the belt-deviation preventing member 470, so that there has been a possibility to damage the fixing belt.

SUMMARY OF THE INVENTION

An object of the present invention is to provide a fixing device for preventing damage of a fixing belt.

An object of the present invention is to provide a fixing device comprising: an endless fixing belt; a heating roller for heating the fixing belt; a fixing roller that has a shaft and extends the fixing belt between the fixing roller and the heating roller; a pressure roller for pressurizing the fixing roller via the fixing belt; and a deviation preventing member that is provided on the shaft of the fixing roller and suppresses moving of the fixing roller in a shaft direction, wherein the fixing roller has an end portion with high hardness and an end portion with low hardness along the shaft direction of the fixing roller, and the end portion with high hardness is in contact with the deviation preventing member.

Another object of the present invention is to provide an image forming apparatus including the fixing device.

PREFERRED EMBODIMENTS OF THE INVENTION

Hereinafter, description will be given for a fixing device and an image forming apparatus of the present invention with reference to drawings.

Figure 1:
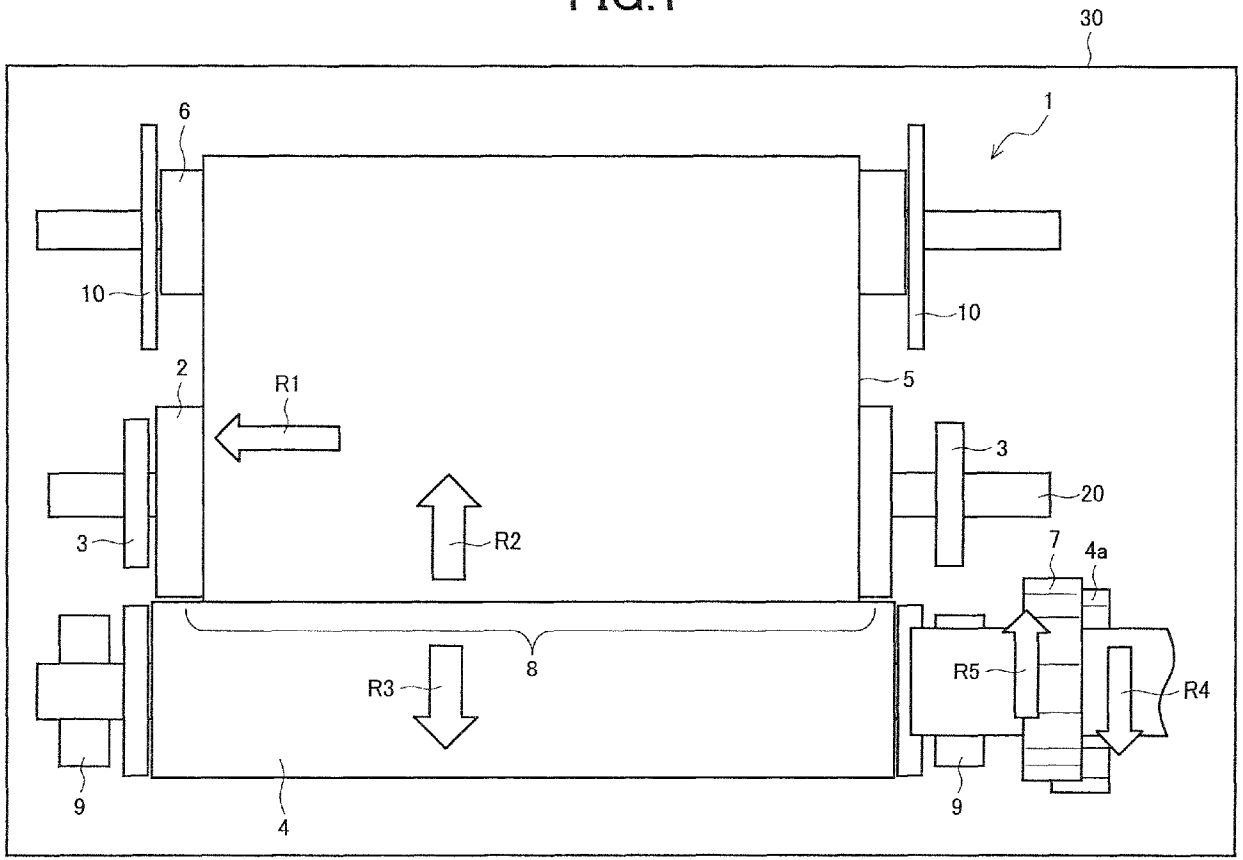
FIG. 1 is a diagram schematically showing an image forming apparatus of the present embodiment.

As shown in FIG. 1, an image forming apparatus 30 is provided with a fixing device 1. The fixing device 1 includes a fixing roller 2, a pressure roller 4, an endless fixing belt 5 and a heating roller 6 for heating the fixing belt 5. The pressure roller 4 includes gears 4*a* and 7, and a pressure holder 9.

Figure 2:
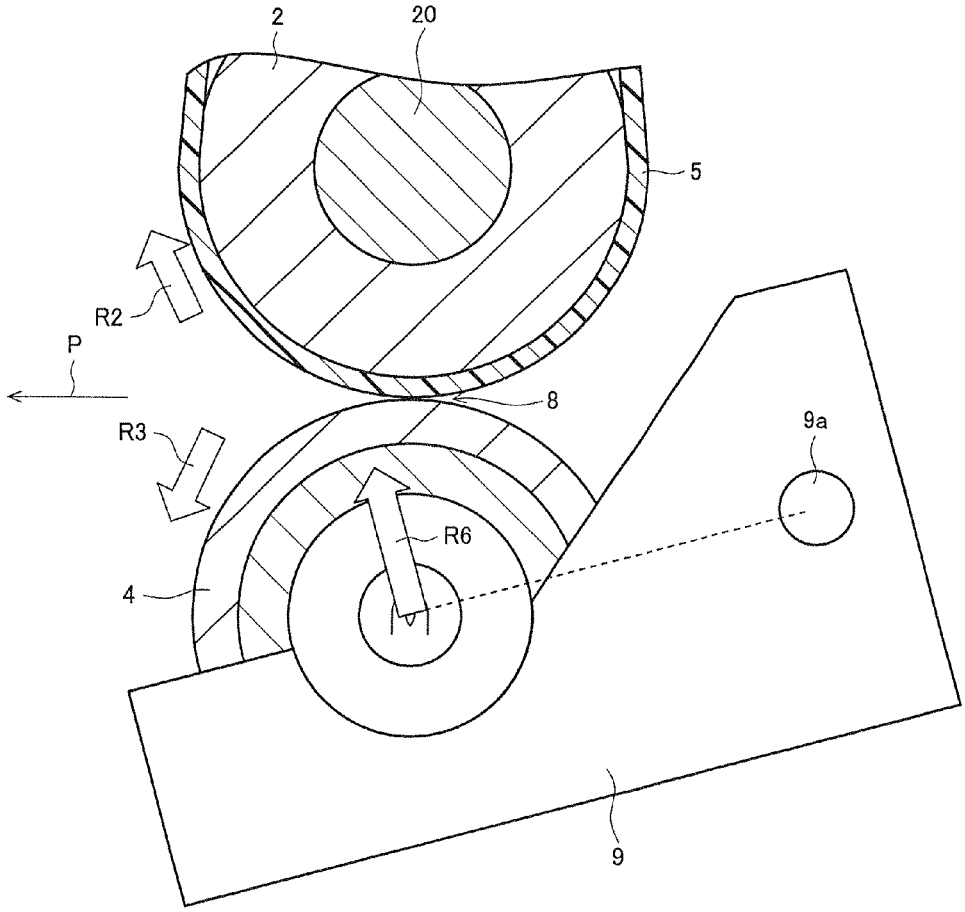
FIG. 2 is a cross-sectional view of a fixing device of the present embodiment.
Figure 3:
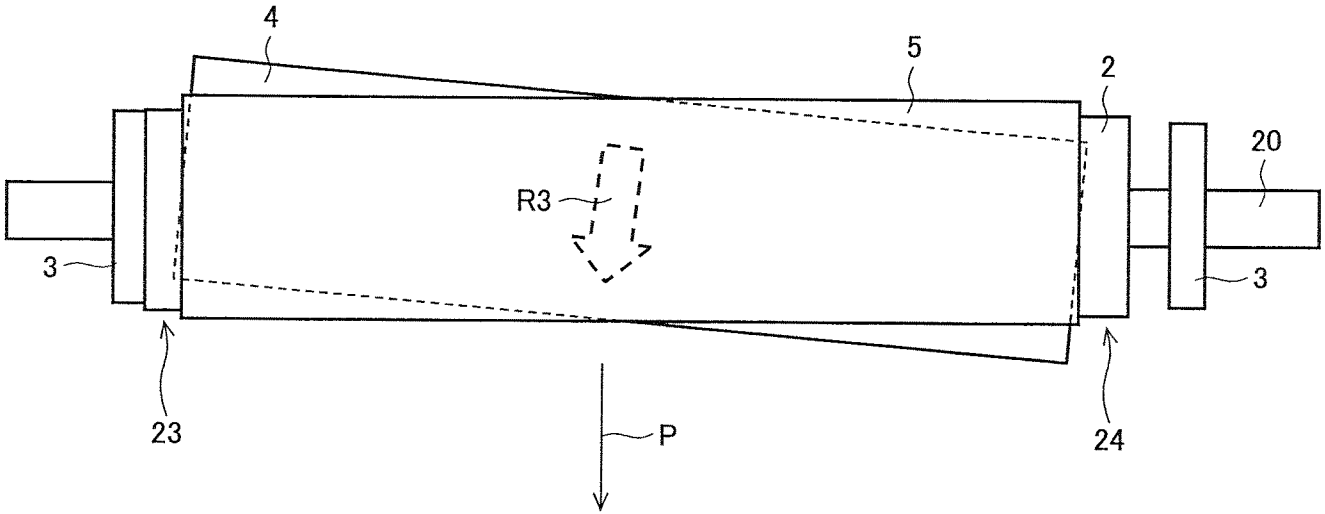
FIG. 3 is a diagram explaining contact of a fixing roller with a deviation preventing member of the present embodiment.
Figure 4C:
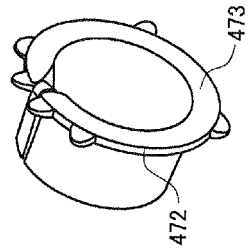
FIG.4C (PRIOR ART)
FIG. 4A to FIG. 4C are diagrams showing a structure of a prior art.
Figure 4A:
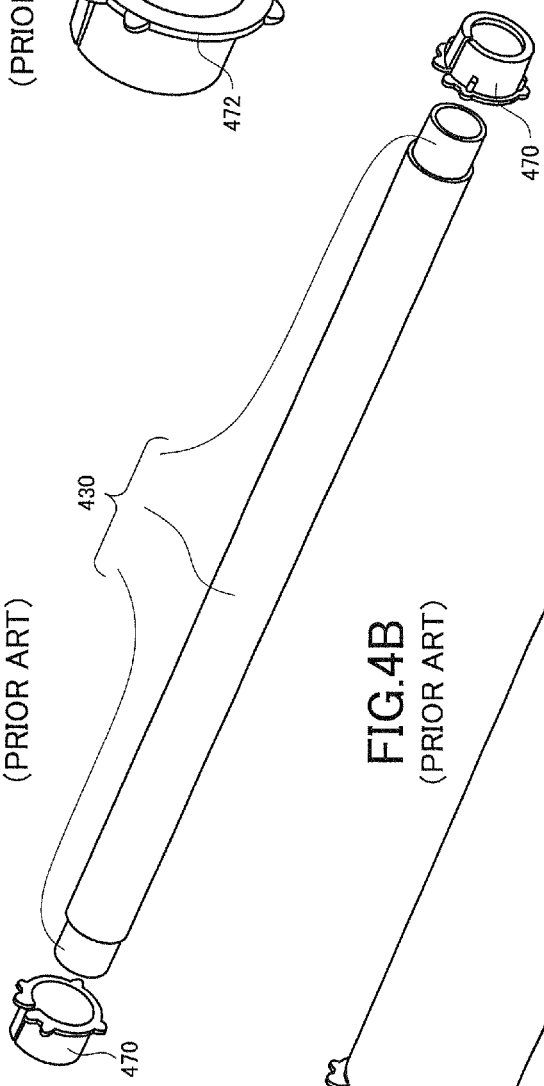
FIG.4A (PRIOR ART)
Figure 4B:
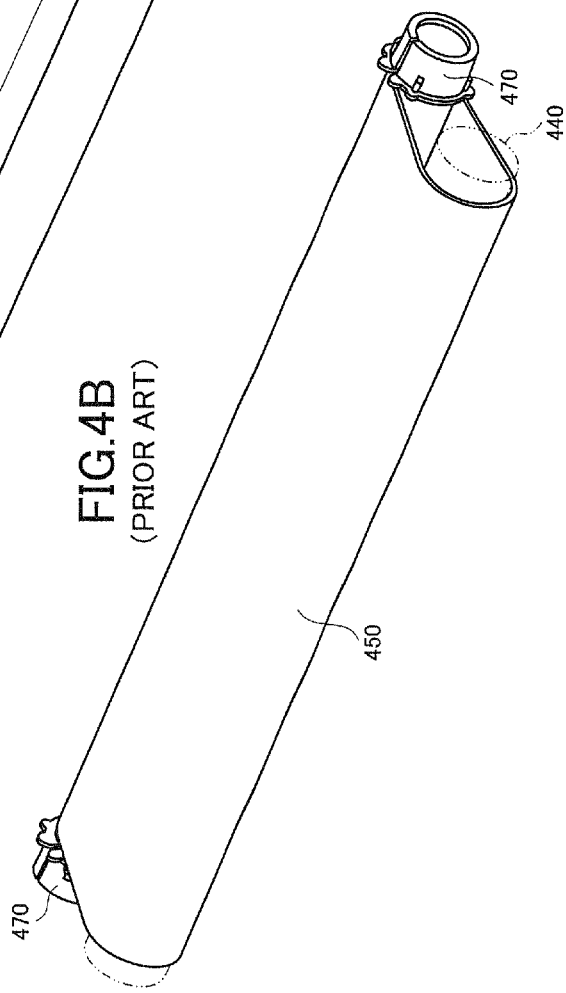
FIG.4B (PRIOR ART)

A front side of FIG. 1 is a paper discharge direction of recording paper, which is indicated by P in FIG. 2 and FIG. 3. Among arrows shown in FIG. 1, R1 denotes a moving direction of the fixing belt 5, R2 denotes a running direction of the fixing belt 5, R3 denotes a rotational direction of the pressure roller 4, R4 denotes a rotational direction of the gear 4*a* and R5 denotes a rotational direction of the gear 7 for drive.

The fixing roller 2 includes, for example, a shaft 20 extending in a longitudinal direction of the roller 2 as well as two layers of a core metal and an elastic layer. The core metal and the elastic layer are formed in an approximate cylindrical shape, and the core metal is located outside the shaft 20, while the elastic layer is located outside the core metal. For the core metal, for example, metal such as iron, stainless steel, aluminum or copper, alloy thereof or the like is used. For the elastic layer, for example, a rubber material with heat resistance such as silicon rubber or fluororubber is used.

In the present embodiment, the fixing roller 2 has an external diameter of 30 mm, in which stainless steel with an external diameter of 20 mm is used for the core metal, and silicon sponge rubber with thickness of 5 mm is used for the elastic layer.

The fixing roller 2 is rotatable around a shaft line of the shaft 20 as a center, and movable along a shaft direction thereof. Note that, in the present embodiment, the shaft 20 is formed in a columnar shape as shown in FIG. 2, however, may be formed in a cylindrical shape. In a case where the fixing roller 2 is rotatable around an axis of the shaft, the fixing roller 2 and the shaft 20 may be integrally formed so that the shaft 20 rotates with the fixing roller 2, or the fixing roller 2 may be formed separately from the shaft 20 so that the shaft 20 does not rotate and only the fixing roller 2 rotates.

A pair of deviation preventing members 3 is provided on, for example, both end sides of the shaft 20 of the fixing roller 2 (FIG. 1). The deviation preventing member 3 has a flange that projects outside from an outer circumferential surface of the shaft 20. In a case where the shaft 20 is fixed to, for example, a casing (illustration is abbreviated) of the fixing device 1 and does not rotate, the flange comes into contact with an end face of the fixing roller 2 which moves along the shaft direction thereof. Thereby, moving of the fixing roller 2 in the shaft direction is regulated.

Note that, the deviation preventing member may be formed to have a cylindrical body and a flange in an annular shape. In a case where the shaft 20 rotates, the deviation preventing member may be a bearing supporting the shaft of the fixing roller so as to rotate freely. An outer periphery of the bearing is fixed to, for example, the casing (illustration is abbreviated) of the fixing device 1.

In the case of viewing along the shaft direction of the fixing roller 2, in the elastic layer of the fixing roller 2, an end portion with high hardness and an end portion with low hardness of the silicon sponge rubber are present. In the present embodiment, the end portion with high hardness is brought into contact with one deviation preventing member 3 of the deviation preventing members 3 provided on both ends of the shaft 20.

Specifically, hardness of the elastic layer of the fixing roller 2 is first measured to mark the end portion with high hardness of both ends in the shaft direction. Then, when the fixing roller 2 is placed in the fixing device, the marked end portion is brought into contact with the deviation preventing member 3 that is located on a side opposite to a position of the gear 4*a* of the pressure roller 4 (deviation preventing member 3 on a left side viewed in FIG. 1). Thus, in the present embodiment, as shown in FIG. 1 and FIG. 3, the deviation preventing member 3 is provided on each of both end sides of the shaft 20, however, the deviation preventing member may be provided only on one side of the shaft 20 (side which is in contact with the end portion with high hardness).

In this manner, in the fixing device of the present embodiment, the end portion with high hardness in the fixing roller is brought into contact with the deviation preventing member that is located on the side opposite to a position of a gear for drive or the like. As the result, it is possible to suppress force deviating to one side of the fixing belt to effectively prevent damage of the fixing belt. A reason why the force deviating to one side of the fixing belt is suppressed will be described below with reference to FIG. 3.

The pressure roller 4 is, for example, rotatable around an axis of a shaft having an approximate cylindrical shape. The pressure roller 4 has three layers of a core metal, an elastic layer and a release layer. The core metal, the elastic layer and the release layer are formed in an approximate cylindrical shape, in which the core metal is located outside the shaft, the elastic layer is located outside the core metal and the release layer is located outside the elastic layer. For the core metal, for example, metal such as iron, stainless steel, aluminum or copper, alloy thereof or the like is used. For the elastic layer, for example, a rubber material with heat resistance such as silicon rubber or fluororubber is used. For the release layer, a synthetic resin material which is a fluorine resin such as a tetrafluoroethylene-perfuluoroalkyl vinyl ether copolymer (PFA) or polytetrafluoroethylene (PTFE) is used.

In the present embodiment, an external diameter of the pressure roller 4 is about 30 mm. For the core metal, iron (STKM) with an external diameter of 28 mm and thickness of 1 mm is used. For the elastic layer, silicon solid rubber with thickness of 1 mm is used. For the release layer, a PFA formed in a tube shape with thickness of 50 μm is used.

The pressure roller 4 incorporates a heating lamp. When a control circuit (illustration is abbreviated) supplies electricity (electrifies) from a power circuit (illustration is abbreviated) to the heating lamp, the heating lamp emits infrared rays. When an inner surface of the pressure roller 4 absorbs the infrared rays, the whole pressure roller 4 is heated. In the present embodiment, for example, a heating lamp with rated power of 300 W is used.

The gear 4*a* of the pressure roller 4 is installed in, for example, an outer periphery of the core metal. The gear 4*a* is engaged with the gear 7 for drive. This gear 7 rotates in the R5 direction of FIG. 1 by a driving motor (illustration is abbreviated). Thereby, the shaft of the pressure roller 4 rotates in the R4 direction of FIG. 1. As described above, silicon solid rubber is used for the pressure roller 4, thus having less profile change and stabilized rotational speed. Therefore, the pressure roller 4 is selected for a driving side.

The fixing roller 2 comes into contact with the pressure roller 4 via the fixing belt 5 to rotate accordingly, and causes the fixing belt 5 to run. The fixing roller 2 and the fixing belt 5 rotate in a direction opposite to the rotational direction R3 of the pressure roller 4, which is the R2 direction of FIG. 1.

The pressure holder 9 is installed in each of both ends of the pressure roller 4, and for example, comes into contact with the core metal of the pressure roller 4 to push the pressure roller 4 up to the fixing roller 2. The pressure holder 9 will be described below with reference to FIG. 2.

The fixing roller 2 is in contact with the pressure roller 4 at a predetermined load, for example, 400 N. In a pressure-contact part between the pressure roller 4 and the fixing belt 5, a fixing nip portion 8 is formed. The fixing nip portion 8 of the present embodiment has width (hereinafter, referred to as "nip width") of 7 mm viewed in a conveyance direction of recording paper.

To the fixing nip portion 8, recording paper carrying an unfixed toner image is supplied. When the recording paper passes through the nip portion 8, the fixing belt 5 comes into contact with a forming face of a toner image of the recording paper, while the pressure roller 4 comes into contact with a back side of the forming face, and the toner image is thus fixed to the recording paper.

The fixing belt 5 has three layers of a base material, an elastic layer and a release layer. The base material is supported by the elastic layer of the fixing roller 2 and a protective layer of the heating roller 6 that is described below. The elastic layer is located outside the base material, and the release layer is located outside the elastic layer. For the base material, for example, a heat-resistant resin such as polyimide, or a metallic material such as stainless steel and nickel is used. For the elastic layer, an elastomer material such as, for example, silicon rubber having excellent heat resistance and elasticity is used. For the release layer, a fluorine resin such as, for example, a PFA or PTFE having excellent heat resistance and release properties is used.

In the present embodiment, the fixing belt 5 is a ring in a circular shape having an external diameter of 50 mm until being extended between the fixing roller 2 and the heating roller 6. For the base material, polyimide with thickness of 50 μm is used, for the elastic layer, silicon rubber with thickness of 150 μm is used, and for the release layer, a PFA formed in a tube shape with thickness of 30 μm is used.

The fixing belt 5 is extended between the fixing roller 2 and the heating roller 6, and runs in the R2 direction of FIG. 1 as with the fixing roller 2. When the pressure roller 4 rotates in the R3 direction, and the fixing belt 5 runs in the R2 direction, recording paper passes through the fixing nip portion 8. The fixing belt 5 is heated at a predetermined temperature by the heating roller 6. Therefore, recording paper carrying an unfixed toner image is heated when passing though the fixing nip portion 8.

The heating roller 6 is rotatable around an axis of a shaft having an approximate cylindrical shape, for example. The heating roller 6 has three layers of an infrared absorbing layer, a core metal and a protective layer. The infrared absorbing layer, the core metal and the protective layer are formed in an approximate cylindrical shape, in which the infrared absorbing layer is located outside the shaft, the core metal is located outside the infrared absorbing layer and the protective layer is located outside the core metal.

The infrared absorbing layer is calcined to be provided after heat-resistant carbon-containing paint is applied to an inner surface of the core metal. For the core metal, for example, metal such as iron, stainless steel, aluminum and copper, or alloy thereof is used. For the protective layer, a fluorine resin such as a PFA or PTFE is used. The protective layer prevents abrasion of the base material of the fixing belt 5, the core metal of the heating roller 6 and the like along with contact of the fixing belt 5 with the heating roller 6.

In the present embodiment, an external diameter of the heating roller 6 is about 28 mm. To the infrared absorbing layer, carbon black having thickness of 100 μm is applied. For the core metal, aluminum with an external diameter of 28 mm and thickness of 1 mm is used. For the protective layer, PTFE with thickness of 50 μm is coated.

Belt-deviation preventing members 10 are provided on both ends of the heating roller 6 to prevent the fixing belt 5 from deviating from the heating roller 6.

The heating roller 6 incorporates a heating lamp (illustration is abbreviated). When a control circuit (illustration is abbreviated) supplies electricity (electrifies) from a power circuit (not shown) to the heating lamp, the heating lamp emits infrared rays. When the infrared absorbing layer of the heating roller 6 absorbs infrared rays, the whole heating roller 6 is heated. In the present embodiment, for example, a heating lamp with rated power of 900 W is used.

To the heating roller 6, a predetermined load, for example, 50 N is imparted toward a direction departing from the fixing roller 2. Thereby, the fixing belt 5 has tension generated, and the heating roller 6 rotates along with run of the fixing belt 5.

FIG. 2 is a cross-sectional view of the fixing device viewed from a gear side of the pressure roller, and a left direction of FIG. 2 is a paper discharge direction P of recording paper.

The pressure holder 9 is supported by a shaft 9*a* extending approximately parallel to the shaft of the pressure roller 4 so as to revolve freely. To the pressure holder 9, for example, force is applied from a spring or the like that is installed in a casing of the fixing device, and the pressure holder 9 revolves around an axis of the shaft 9*a* to push each of both ends of the pressure roller 4 up to the fixing roller 2. Thereby, the pressure roller 4 holds the fixing belt 5 with the fixing roller 2 which is pressurized, so as to obtain nip width and pressure required for fixing.

As shown in FIG. 2, when the pressure holder 9 revolves around an axis of the shaft 9*a*, as indicated with an R6 direction, the pressure roller 4 inclines, for example, to the paper discharge direction P side from a position connecting a center of the shaft of the pressure roller 4 and a center of the shaft 20 of the fixing roller 2 to be pressed by the pressure holder 9.

When hardness of the elastic layer of the fixing roller 2 differs at both ends from each other viewed in the shaft direction of the fixing roller 2, a pressure-contact level of the pressure roller 4 and the fixing roller 2 differs at the both ends of the fixing roller 2 from each other. Hardness of the silicon sponge rubber used for the elastic layer of the fixing roller 2 is generally uneven in rubber of the same product. Hardness varies, in the case of being measured with an Asker C durometer, in a range of 40±3 degrees in rubber of the same product, for example. Hardness of both ends of the elastic layer also varies, and when hardness of both ends of the silicon sponge rubber that is used for the present embodiment is measured, hardness of an end portion with low hardness was about 37 degrees, and hardness of an end portion with high hardness was about 43 degrees.

That is, the end portion with low hardness of the fixing roller 2 is pressed more deeply by the pressure roller 4 compared to the end portion with high hardness. The fixing roller 2 and the pressure roller 4 rotate in a direction discharging recording paper in the paper discharge direction P (R2 direction, R3 direction). In the present embodiment, the pressure holder 9 pushes the pressure roller 4 up to the paper discharge direction P side (R6 direction). Therefore, an end part in contact with the end portion with low hardness largely moves to the paper discharge direction P side compared to an end part in contact with the end portion with high hardness.

FIG. 3 is a diagram in which the fixing roller 2 and the pressure roller 4 are viewed from the fixing roller 2 side. Note that, illustration of the heating roller 6 is abbreviated, and an inclination of the pressure roller 4 is emphatically depicted.

In the elastic layer of the fixing roller 2, an end portion with high hardness 23 is located on a left side of FIG. 3, and an end portion with low hardness 24 is located on a right side of FIG. 3. As shown in FIG. 3, an end part of the pressure roller 4 in contact with the end portion with low hardness 24 moves closer to the paper discharge direction P side compared to an end part of the pressure roller 4 in contact with the end portion with high hardness 23. Thus, the shaft of the pressure roller 4 inclines with respect to the shaft 20.

Since friction force is generated in the fixing nip portion 8, the fixing belt 5 is made easier to move toward the end portion with high hardness 23 side (left side of FIG. 3) along with rotation of the inclined pressure roller 4 (R3 direction). Moreover, the fixing roller 2 is driven by the moved fixing belt 5, thus making it easier also for the fixing roller 2 to generate force toward the left side of FIG. 3.

In a conventional structure, force for causing the fixing roller to move in the shaft direction and force for causing the fixing belt to move in the width direction which get together make force deviating to one side of the fixing belt larger. Thus, the fixing belt is brought into extreme contact with the belt-deviation preventing member so that the fixing belt is damaged in some cases.

However, in the fixing device of the present embodiment, the end portion with high hardness 23 of both ends of the fixing roller is brought into contact with the deviation preventing member 3 that is located on a side opposite to a position of the gear 4*a* of the pressure roller 4 (deviation preventing member 3 on a left side viewed in FIG. 1 and FIG. 3). Therefore, moving of the fixing roller 2 is able to be suppressed so that force causing the fixing roller to move in the shaft direction is made difficult to be generated. As the result, force deviating to one side of the fixing belt 5 is made smaller so that it is possible to prevent damage of the fixing belt 5.

The invention claimed is:

1. A fixing device comprising:

an endless fixing belt;

a heating roller for heating the fixing belt;

a fixing roller that has a shaft and extends the fixing belt between the fixing roller and the heating roller;

a pressure roller for pressurizing the fixing roller via the fixing belt; and a deviation preventing member that is provided on the shaft of the fixing roller and suppresses moving of the fixing roller in a shaft direction, wherein the fixing roller has an end portion with high hardness and an end portion with low hardness along the shaft direction of the fixing roller, and the end portion with high hardness is in contact with the deviation preventing member.

2. An image forming apparatus including the fixing device as defined in claim 1.

* * * * *